United States Patent [19]

Yousoufian

[11] 4,015,562

[45] Apr. 5, 1977

[54] MOISTURE SEPARATOR AND REHEATER

[75] Inventor: Hrant Harry Yousoufian, Montclair, N.J.

[73] Assignee: Foster Wheeler Energy Corporation, Livingston, N.J.

[22] Filed: July 25, 1975

[21] Appl. No.: 599,214

[52] U.S. Cl. ..... 122/483; 122/32; 55/269

[51] Int. Cl.[2] ..... F22G 1/00

[58] Field of Search ..... 55/269, 418, 440, 463; 122/32, 483, 488, 491

[56] References Cited

UNITED STATES PATENTS

| | | | |
|---|---|---|---|
| 3,500,796 | 3/1970 | Roffler | 122/34 |
| 3,713,278 | 1/1973 | Miller et al. | 122/483 |
| 3,923,010 | 12/1975 | Chlique | 122/483 |

*Primary Examiner*—Kenneth W. Sprague
*Attorney, Agent, or Firm*—Marvin A. Naigur; John E. Wilson

[57] ABSTRACT

This invention relates to an apparatus for removing moisture from wet steam and reheating the steam. The moisture laden steam is directed into the apparatus to be distributed to dryers and then flows upwardly across a bundle of tubes through which hot steam is flowing to superheat the vapor.

6 Claims, 7 Drawing Figures

FIG. 2
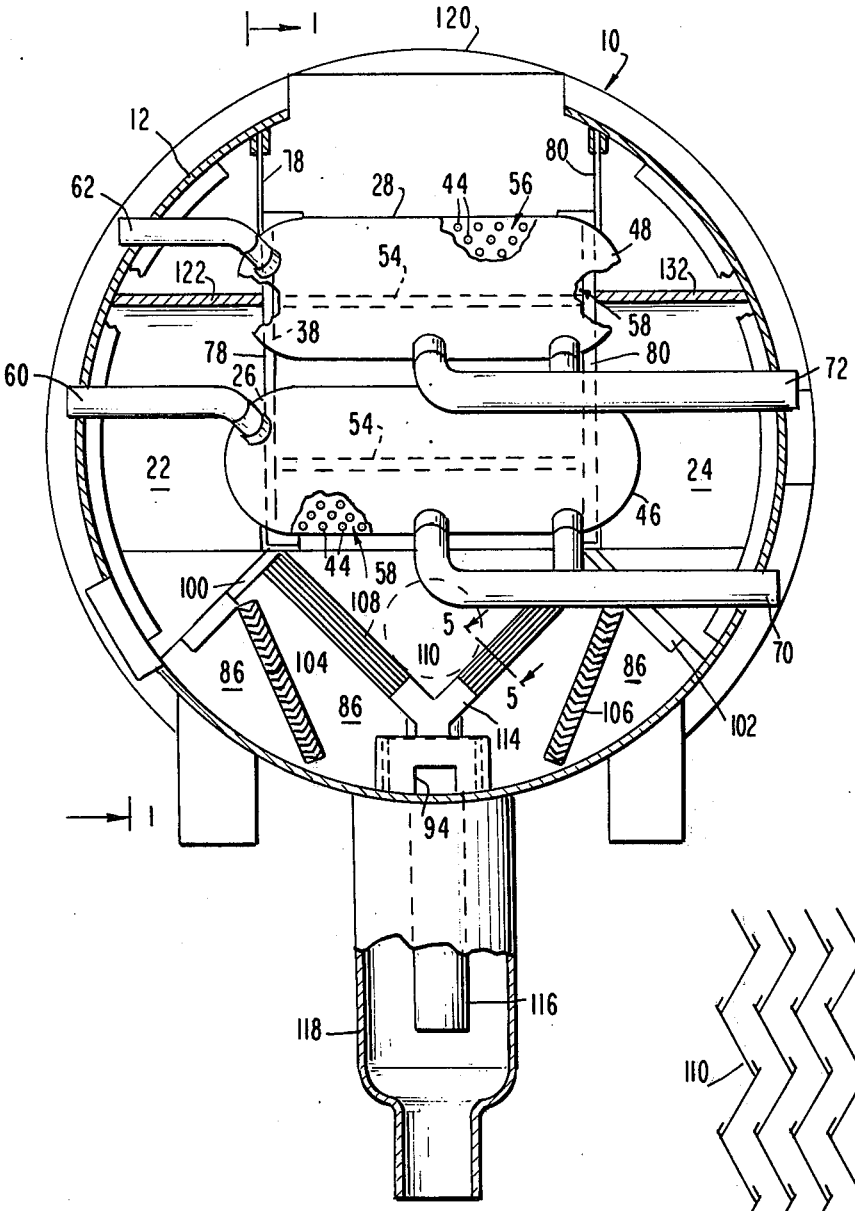
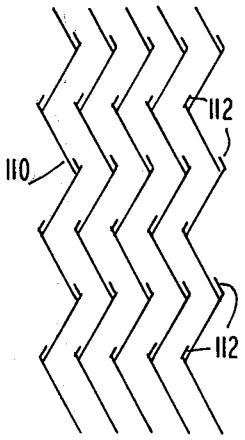
FIG. 5
FIG. 6
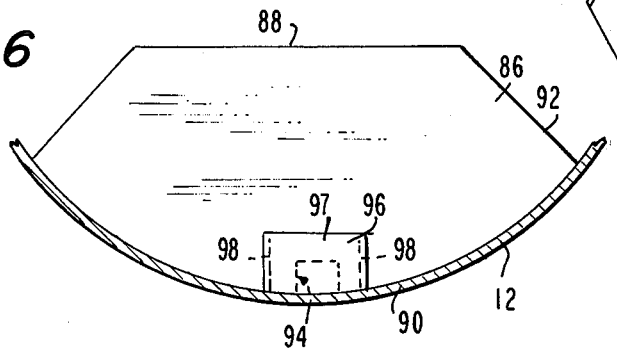

MOISTURE SEPARATOR AND REHEATER

BACKGROUND OF THE INVENTION

In some modern steam power plants of large capacity, high temperature saturated steam is produced in a steam generator and used to drive steam turbines. After passing through a high pressure turbine, the steam is used to drive another turbine at lower steam pressures. Conventionally, the wet steam leaving the high pressure turbine is dried and reheated before being used to drive the lower pressure turbines. This is accomplished in an apparatus which is often separate from the steam generator. The apparatus removes the moisture entrained in the steam leaving the high pressure turbine and also reheats the steam so that it is of a quality suitable for driving the lower pressure turbines.

To be efficient, the apparatus for removing the moisture from and reheating the steam leaving a high pressure turbine must treat a large amount of steam at minimal pressure drop. The apparatus must be able to remove all or most of the moisture entrained in the steam leaving the high pressure turbine and to reheat the steam to a quality which allows efficient operation of the lower pressure turbines.

In the past it has been found difficult to design a moisture separator and reheater apparatus which will treat a large volume of steam flowing at a high velocity and which contains much moisture. The moisture separator and reheater apparatus can become overloaded to the point where it no longer removes all of the moisture from the steam and thereby reduces the overall efficiency of the plant.

SUMMARY OF THE INVENTION

It is an object of the present invention to overcome drawbacks found in the prior art such as those discussed above. Accordingly, the present invention provides a moisture separator and reheater apparatus comprising a horizontally elongated casing, a pair of side plates extending upward and longitudinally in said casing, a bundle of tubes between said plates for flowing heating vapor, a steam inlet at one end of said apparatus, a steam outlet through said shell above and between said pair of side plates, a steam baffle bridging said plates adjacent to said steam inlet so that steam coming in through said steam inlet will impinge against said baffle to separate into two streams, each of said streams flowing between one of said side plates and said casing, a plurality of first vanes parallel to each other and a plane perpendicular to the longitudinal axis of said apparatus, each of said vanes extending downward and outward from said side plates, a pair of zigzag moisture separators below said bundle of tubes, said separators each extending downward and inward from said side plates, a plurality of second vanes, said second vanes being curved over their width, parallel to each other and the longitudinal axis of said apparatus, said second vanes being positioned between said moisture separators and said first vanes so that steam from said streams will be deflected inward and downward by said first vanes and then upward and inward by said second vanes to approach said separators at an angle substantially perpendicular to said separators and then flow up over said tubes and out of said apparatus through said vapor outlet, and a pair of top plates, each of said top plates extending between one of said side plates and said shell, each of said top plates being inclined downward away from said vapor inlet so that the steam in said streams will move at a substantially uniform velocity under said top plates.

BRIEF DESCRIPTION OF THE DRAWINGS

FIG. 2 is an end view partly in section taken substantially along the line 2—2 of FIG. 1.

FIG. 5 is a view of a zig-zag separator taken along its line 5—5 of FIG. 2; and

FIG. 6 is a partial mass section showing a water column seal and its associated structure.

DESCRIPTION OF THE PREFERRED EMBODIMENT

Figure 1A:
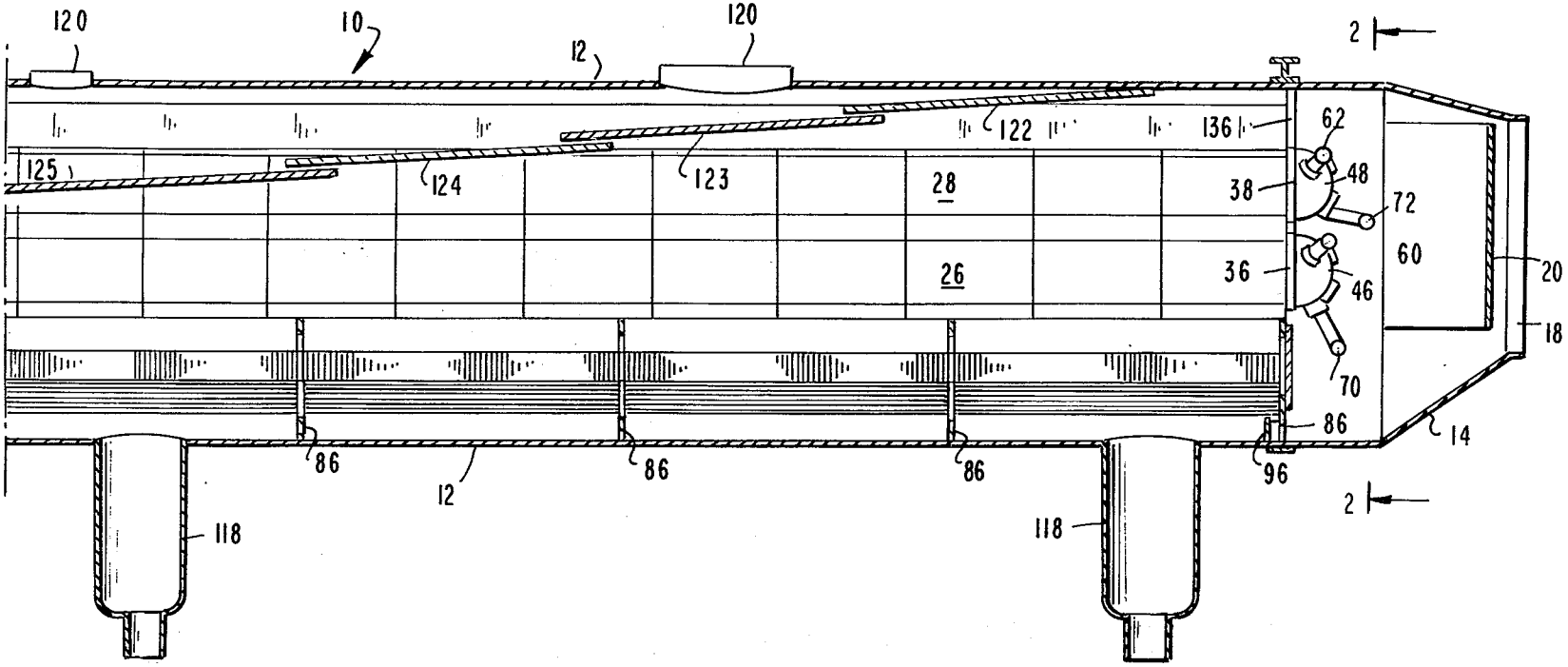
FIGS. 1A and B are vertical longitudinal views taken partly in section and substantially along the line 1—1 of FIG. 2.

FIGS. 1A and B show a moisture separator reheater indicated generally as 10 having a generally cylindrical horizontally extending casing 12 which is positioned between an inlet end bell 14 and an end bell 16. The inlet bell 14 is tapered so that it connects the steam inlet 18 with the cylindrical casing 12. A vapor baffle 20 is positioned within the inlet end bell and may be a vertical cylindrical section and which separates the incoming vapor into two streams, each of which passes through the casing 12 to vapor ducts 22 and 24 which are positioned adjacent to the sides of the present moisture separator and reheater 10. As shown in FIGS. 1 and 2, the vapor ducts 22 and 24 pass along the sides of four tube bundles 26, 28, 30, and 32 which are positioned within the outer shell 12. The tube bundles 26 and 28 are positioned on the end of the moisture separator and reheater 10 which is closest to the inlet end bell 14 whereas, the tube bundles 30 and 32 are in the end of the moisture separator and reheater 10 closest to the end bell 16. Tube bundles 28 and 32 are positioned directly above tube bundles 26 and 30 respectively. Each of the tube bundles 26, 28, 30, and 32 include a tube sheet 36, 38, 40, and 42 respectively. The tube sheets 36 and 38 are positioned adjacent to the steam inlet 18 while tube sheets 40 and 42 are positioned adjacent to the end bell 16. A plurality of U-tubes 44 may extend inwardly toward the center of the moisture separator and reheater 10 from each of the tube sheets 36, 38, 40 and 42 to make up the tube bundles 26, 28, 30, and 32 respectively.

The tube sheets are each covered over their outer sides by a header. Thus, the tube sheets 36, 38, 40, and 42 are connected to headers 46, 48, 50, and 52 respectively. Each header contains a divider plate 54 which completely segregates the upper leg of each U-tube from the lower leg thereof thus forming two chambers 56 and 58 inside each header 46, 48, 50, and 52. Each upper chamber 56 communicates with each lower chamber 58 through each of the U-tubes 44 connected to the associated tube sheets 36, 38, 40, or 42. Heating vapor enters the present moisture separator and reheater through heating vapor pipes 60, 62, 64, and 66 and flows into the upper chambers 56 and then through the U-tubes 44 of each of the tube bundles 26, 28, 30, and 32. The divider plates 54 prevent the vapor coming from steam pipes 60, 62, 64, and 66 from reaching the lower chambers 58 except through the upper and lower legs of each of the U-tubes 44. As will be explained later, the heating vapor in the U-tubes 44 gives up heat so that it may reach the lower chambers 58 in the form of condensate. At any rate, the heating fluid, whether in gaseous or liquid form, leaves the present moisture separator and reheater through heating vapor outlets 70, 72, 74, and 76.

The steam to be reheated passes upwardly across the U-tubes 44 and between two laterally disposed side plates 78 and 80 which are positioned on either side of the tube bundles 26 and 28 and the tube bundles 30 and 32. The top edges of the side plates 78 and 80 abut against the casing 12 and the bottom edges of the side plates 78 and 80 rest on the supports 86. As shown in FIG. 2, expansion joints are provided on the shell 12 for the top edges of the side plates 78 and 80.

The steam flows into the space between the side plates 78 and 80 from the steam ducts 22 and 24 which, as explained above, convey the wet steam longitudinally through the entire moisture separator and reheater 10. The duct 22 extends outwardly of the side plates 78 and adjacent to the casing 12. The duct 22 is generally above each of a number of laterally extending support plates 86, one of which is shown by itself in FIG. 4. The supports 86 support the sideplates 78 and 80 as well as the tube bundles 26, 28, 30, and 32 with their associated tube sheets 36, 38, 40, and 42 and headers 46, 48, 50, and 52. The support plates 86 each have a horizontal straight upper edge 88 and a curved lower edge 90. The lower edge 90 abuts against the bottom of the shell 12 and the upper edge 88 is positioned directly under the tube bundles.

Figure 4:
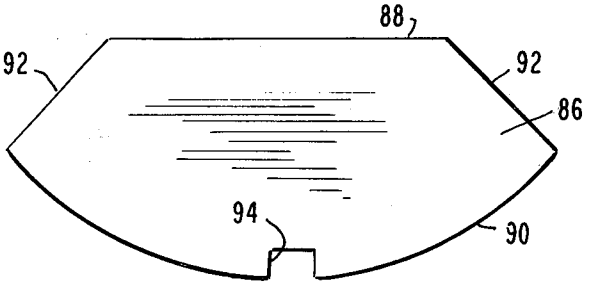
FIG. 4 is a view of one of the supports of the present invention.
Figure 3:
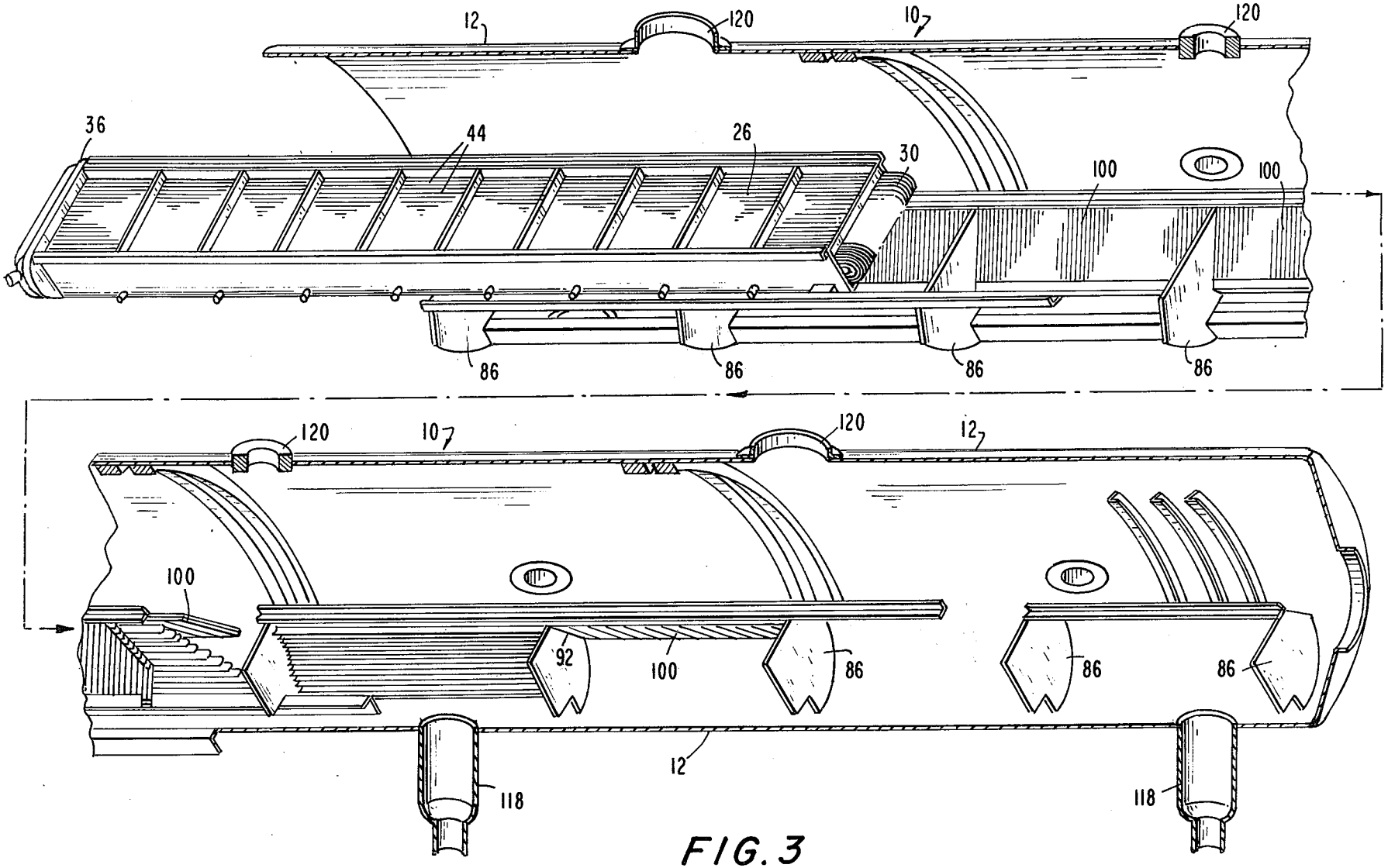
FIG. 3 is an isometric view, partly in section, with parts removed and broken away to show the arrangement of several of the components of the present invention.

The support 86 also includes side edges 92 which extend at an angle of approximately 45° to the vertical as shown in FIG. 4. A notch 94 is provided in the bottom of the support 86 to provide for a water drain as will be presently described. The two supports 86 adjacent to the inlet end bell 14 and the end bell 16 each have a water column seal 96 on the sides thereof facing the center of the moisture separator and reheater 10. Each of the water column seals 96, as shown in FIG. 6, have a vertical plate 97 parallel to and spaced inwardly of its associated support 86 which at its bottom abuts against the bottom of the casing 12. Side plates 98 extend between the vertical plate 97 and the support 86. During operation each of the water column seals 96 hold a column of condensate which covers the support 94 to prevent steam from flowing through the slot 94 and directly through the separators 108. Thus, the water column seals 96 will assure that the steam flowing through the ducts 22 and 24 will all flow through the spaces between adjacent supports 86 and through the vanes 100, 102, 104 and 106 between those supports before approaching the moisture separator 108.

A plurality of vanes 100 and 102 which are generally parallel to the supports 86 extend between the side edges 92 of each pair of adjacent supports 86. The effect of the vanes 100 is to cause the wet steam flowing longitudinally down the ducts 22 and 24 to flow in a direction perpendicular to the ducts 22 and 24, progressively along the longitudinal direction of ducts 22 and 24, which direction is downward and inward toward the center of the moisture separator and reheater 10.

As the steam flows downward and inward between the supports 86, it encounters between each pair of adjacent supports 86 a panel of curved vanes 104 and 106 the longitudinal plane of each panel perpendicular to the supports 86. The vanes 104 form panels each being adjacent to the vanes 100 whereas the curved vanes 106 form panels adjacent to the vanes 102. Extending between each pair of adjacent supports 86 and symmetric about the vertical centerline of each support is a pair of moisture separators 108 and 110 which obtain an included angle of approximately 90°. The separators are of a "zig-zag" or "chevron" design such as shown in FIG. 5 and include a plurality of small gutters 112 for carrying any moisture separated from the wet steam to a moisture collector 114 which is located along the bottom of the shell 12 and is connected to a number of longitudinally spaced drain pipes 116 each of which extend down into a hot well 118.

The curved vanes 104 and 106 are designed and positioned so that steam flowing from the vanes 100 and 102 respectively will be deflected upward and inward so that it approaches the moisture separators 108 and 110 at an angle substantially perpendicular to the moisture separators 108 and 110. It has been found that this arrangement allows for optimum performance of the moisture separators 108 and 110 and also permits the greatest design predictability possible.

After leaving the moisture separators 108 and 110 the steam flows upwardly between the side plates 78 and 80 and across the U-tubes 44 of the tube bundles 26, 28, 30, and 32. While passing across the U-tubes 44, the steam is reheated and thereby superheated. The superheated steam then passes upward and out of the present moisture separator and reheater 10 through outlets 120 positioned at the top of the casing 12 between the side plates 78 and 80. Typically, this steam is conveyed through large ducts to a turbine which operates at a pressure less than the turbine from which the steam was received at the inlet 18 of the moisture separator and reheater 10.

In order to assure optimum performance of the moisture separators 108 and 110, it has been found that besides assuring that the direction of the wet steam approaching those separators must be perpendicular, but additionally, it is important that the steam flows through the separators at a velocity that is not so high that the moisture in the steam is carried through the separators. In order to provide a moisture separator and reheater where the velocity approaching the moisture separators 108 and 110 does not exceed that at which the moisture is efficiently separated from the steam, it is necessary to design the steam ducts 22 and 24 so that the velocity diminishes continuously at a low rate throughout its course through the ducts 22 and 24, such that the energy losses in executing the change in flow direction through vanes 100 and 102 is substantially uniform and the resulting flow of wet steam through the vanes 100 and 102 is uniform. To this end, top plates 122–129 are provided at the top of duct 22 as shown best perhaps in FIGS. 1A and 1B, each plate 122–129 sloping downward progressively in the longitudinal direction away from steam inlet 18. Thus, the ducts 22 and 24 have a cross-sectional area which decreases in proportion to the distance from the inlet 18. The slope of the top plates 122–129 and thus the change in cross-sectional area is selected so as to insure a controlled, low rate of reduction of velocity of the wet steam over the length of the duct 22. The duct 24 has a similar series of top plates, one of which 132 is shown in FIG. 2. In each duct the top plates overlap at their end portions so that condensate accumulating under the top plates will flow over the top of the succeeding downstream plate. A stagnant region of vapor exists between the top plates and the casing 12 so that the pressure above the plates equals that below the plates. The condensate thus flows from plate to plate to the end bell 16 where it can be drained off by means not shown. This will assure a more or less uniform flow through each of the sets of vanes 100 and 102 between each of the supports 86. Since the vanes 100 and 102 are positioned to turn vapor in a direction perpendicular to the direction of flow in ducts 22 and 24, the steam flowing between the supports 86 is, essentially, parallel to those supports as it flows inward to the vanes 104 and 106. The vanes 104 and 106 then turn the steam so that it approaches the separators 108 and 110 substantially perpendicular to those separators. The steam then passes upwardly across the U-tubes 44 to be reheated while the separated fluid moves down through the collectors 114 and drain pipes 116 into the hot wells 118.

Figure 1B:
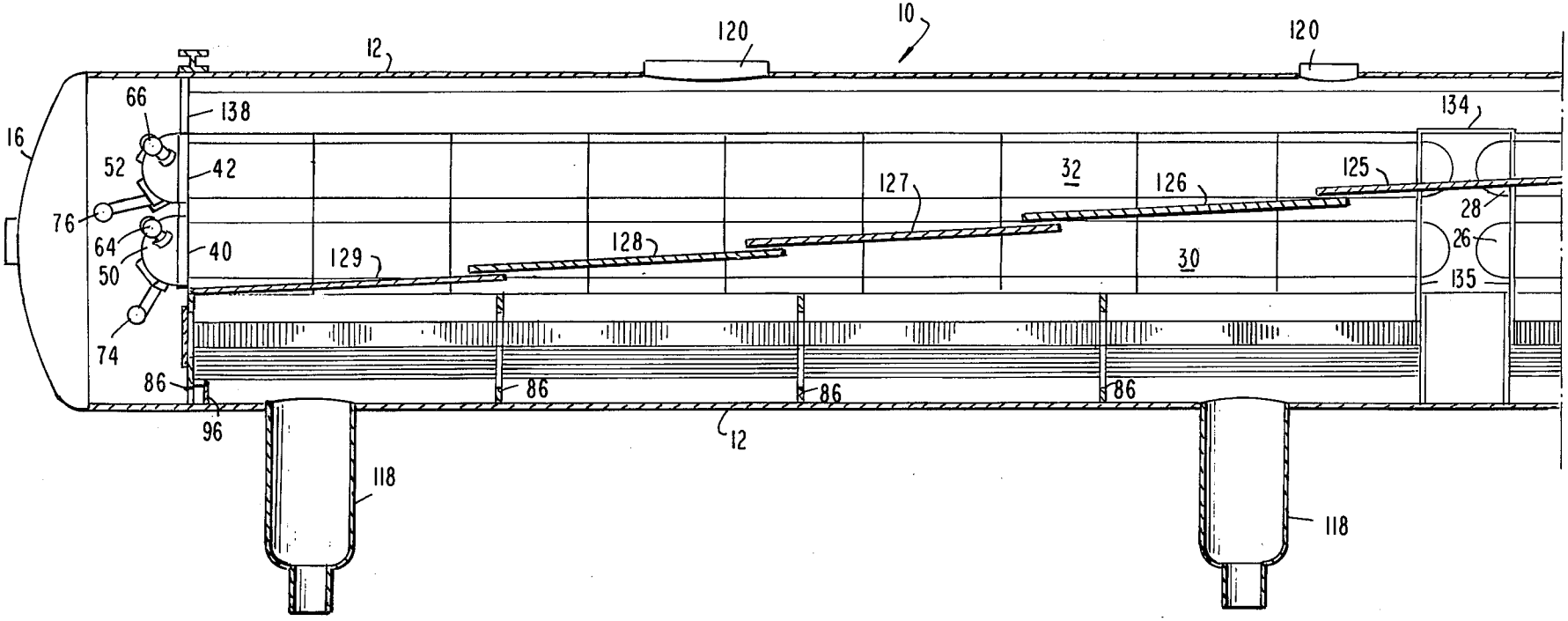

A cover plates 134 extends between the side plates 78 and 80 over the space between the inner ends of the tube bundles 26, 28, 30 and 32 as shown in FIG. 1B. The cover plate 134 bridges two vertically extending tube support plates 135 which extend from the tops of two of the supports 86 and between the side plates 78 and 80. The cover plate 134 prevents wet steam from passing between the tube bundles without being heated. A volume of stagnant steam collects under the cover plate 132 and between the tube sheets 135 so that steam flowing through the steam ducts 22 and 24 will not enter the area between the inner ends of the tube bundles 26, 28, 30 and 32 but will all flow through vanes 100, 102 and the curved vanes 104 and 106 and through the moisture separators 108 and 110.

A face plate 136 extends from the top of tube sheet 38 to the shell 12 to prevent wet steam from flowing from the end bell 18 to the space within the side plates 78 and 80 without passing across the tube bundles 26, 28, 30 and 32. Similarly, a face plate 138 extends between the top of the tube sheet 42 and the shell 12 to prevent steam from flowing from the end bell 16 to the spaces between the side plates 78 and 80 over the tube bundle 32. If the cover plate 138 were not present, steam could flow through the steam ducts 22 and 24 to the end bell 16 and then to the space between the side plates 78 and 80 over the tube bundle 32 without ever having passed through the moisture separators 108 and 110 and the tube bundles 26, 28, 30 and 32.

The foregoing describes one preferred embodiment of the present invention; other embodiments being possible without exceeding the scope thereof as described in the following claims.

What is claimed is:

1. Apparatus for separating moisture from and reheating steam comprising:

a horizontally elongated casing;

a pair of side plates extending upward and longitudinally in said casing;

a bundle of tubes between said plates for flowing heating vapor;

a steam inlet at one end of said apparatus;

a steam outlet through said shell above and between said pair of side plates;

a steam baffle bridging said plates adjacent to said steam inlet so that steam coming in through said steam inlet will impinge against said baffle to separate into two streams, each of said streams flowing between one of said side plates and said casing;

a plurality of first vanes parallel to each other and a plane perpendicular to the longitudinal axis of said apparatus, each of said vanes extending downward from said side plates;

a pair of zig-zag moisture separators below said bundle of tubes, said separators each extending downward and inward from said side plates;

a plurality of second vanes, parallel to each other and the longitudinal axis of said apparatus, said second vanes being positioned between said moisture separators and said first vanes so that steam from said streams will be deflected inward and downward by said first vanes and then upward and inward by said second vanes to approach said separators at an angle substantially perpendicular to said separators and then flow up across said tubes and out of said apparatus through said vapor outlet, each of said second vanes being curved over its width to substantially conform to the path said stream takes while travelling between said second vanes; and a pair of top plates, each of said top plates extending between one of said side plates and said shell to define the top of one of said streams, each of said top plates being inclined downward away from said steam inlet so that the steam flowing in said streams will move at a substantially uniform velocity.

2. The apparatus defined in claim 1 wherein said first vanes extend outward from said side plates.

3. The apparatus defined in claim 1 wherein the axes of said second vanes all lie in a plane extending upward and outward from a location below said first vanes.

4. The apparatus defined in claim 3 further comprising a moisture collector adjacent the bottoms of said separators for collecting moisture draining off said separators.

5. The apparatus defined in claim 4 further comprising a plurality of water drains extending downward from said moisture collector, a plurality of hot wells with each of said water drains extending down into said hot well.

6. The apparatus defined in claim 5 wherein said pair of top plates is one of a series of top plates, each of said top plates overlapping the adjacent downstream top plate at the end portions thereof so that condensate collecting under said top plates will flow between the overlapped top plates and then over succeeding top plates and beyond said stream.

* * * * *